US006883998B2

(12) United States Patent
Bullivant

(10) Patent No.: US 6,883,998 B2
(45) Date of Patent: Apr. 26, 2005

(54) CONNECTOR

(75) Inventor: Roger A. Bullivant, Burton on Trent (GB)

(73) Assignee: Global Innovations, LLC, Grand Prairie, TX (US)

( * ) Notice: Subject to any disclaimer, the term of this patent is extended or adjusted under 35 U.S.C. 154(b) by 45 days.

(21) Appl. No.: 10/022,131

(22) Filed: Dec. 13, 2001

(65) Prior Publication Data

US 2002/0164202 A1 Nov. 7, 2002

(30) Foreign Application Priority Data

Mar. 27, 2001 (GB) ..... 0107598

(51) Int. Cl.[7] ..... F16G 11/00

(52) U.S. Cl. ..... 403/313; 403/300; 52/740.7; 411/324; 411/389; 411/395

(58) Field of Search ..... 411/324, 389, 411/395, 411, 424, 947; 285/333, 334.1; 52/740.7, 726.1, 740.1; 403/300–305, 307, 310, 313

(56) References Cited

U.S. PATENT DOCUMENTS 3,238,732 A 3/1966 Aas-Jakobsen
4,408,926 A * 10/1983 Werner ..... 403/310
4,813,717 A * 3/1989 Watts ..... 285/333
4,836,717 A 6/1989 Landaeus et al.
5,406,983 A * 4/1995 Chambers et al. ... 285/294.1 X
5,729,952 A 3/1998 Dahl
6,265,065 B1 * 7/2001 McCallion ..... 52/740.1 X

FOREIGN PATENT DOCUMENTS

EP 0 098 099 A2 1/1984

* cited by examiner

*Primary Examiner*—John R. Cottingham
(74) *Attorney, Agent, or Firm*—Sidley Austin Brown & Wood LLP

(57) ABSTRACT

A connector for connecting elongate members, such as pile sections, in an end-to-end relationship. A housing is fitted to each end of a reinforcing bar in the elongate member. The housing has a first attachment socket at one end, the first attachment socket having an internal thread for accommodating helical protrusions formed on an outer surface of a standard reinforcing bar. A second attachment socket having a circular cross section is provided at the other end of the housing. Protrusions having a saw tooth cross section project inwardly from the second socket walls. The connector also includes an initially separate joining member which comprises a hollow cylinder having a short central portion with no protrusions therefrom and serrated sections extending from each end thereof, each having protrusions of a configuration corresponding to the configuration of the protrusions from the second attachment socket.

28 Claims, 3 Drawing Sheets

CONNECTOR

This application is based on, and priority is claimed from, patent application 0107598.5 filed in the United Kingdom, on Mar. 27, 2001.

FIELD OF THE INVENTION

The present invention relates to improved connectors, especially, but not exclusively, connectors for interconnecting lengths of reinforcing steel for use in reinforced concrete members. The present invention has particular application to the interconnection of the reinforcing steel members of sectional pre-cast concrete piles, but is not limited to this application.

BACKGROUND OF THE INVENTION

There are many occasions when, in casting reinforced concrete members, one length of reinforcing steel has to be connected at its end to another length to form a continuous member. To ensure the integrity of the finished member, it is essential that the tensile strength of the interconnection is at least as great as the tensile strength of the reinforcement.

Various interconnectors have been used in the past. For example, hollow threaded interconnection members have been provided, and ends of a reinforcing bar have been correspondingly threaded. In another prior example, rather than using a threaded interconnection, an interconnecting sleeve has been crimped to an end of one section of a reinforcing bar and connected by a thread to a second section. Where this has proved disadvantageous, the second section of the bar has been fixed within the connector by an epoxy resin adhesive. In other applications, one length of reinforcing steel has been welded to another.

Prior arrangements of this nature have suffered from disadvantages, not only from cost considerations, but also from difficulty of connection and time taken to connect.

SUMMARY OF THE INVENTION

An object of the present invention is to provide a connector that is particularly well suited for connecting one elongated member to another in an end-to-end relationship.

Another object of the present invention is to provide a connector that can be quickly and easily assembled.

A connector, in accordance with the present invention, comprises a housing having a first interior surface defining a first passage that extends in an axial direction between a first aperture and an intermediate portion of the housing, and a second interior surface defining a second passage that extends in the axial direction between a second aperture and the intermediate portion of the housing. The connector also comprises a joining member for joining the housing to a second such housing, the member having an exterior surface. The first interior surface of the housing includes a first mating surface, and the exterior surface of the joining member includes a second mating surface, wherein the first and second mating surfaces are configured such that the joining member can be inserted and thereby locked into the first passage of the housing. The second interior surface can include a threaded surface.

The exterior surface of the housing can have one or more an extending portions which extend radially from the housing, and also extend in the axial direction between the second aperture and the intermediate portion.

The first mating surface of the housing can include a plurality of protruding portions, each protruding portion extending in a direction perpendicular to the axial direction, each protruding portion having a saw-tooth cross section that is sloped towards the first aperture and flat towards the intermediate portion of the housing.

The joining member can be configured such that it extends in a longitudinal direction, and the second mating surface thereof includes a plurality of protruding portions, each protruding portion extending in a direction perpendicular to the longitudinal direction, and each protruding portion having a saw-tooth cross section that is sloped towards a first end of the joining member and is flat towards a second end of the joining member.

The exterior surface of the joining member can also be configured such that it extends between the first end and the second end of the joining member and includes an intermediate portion thereof, wherein the second mating surface extends between the first end and the intermediate portion, and wherein the exterior surface includes a third mating surface that extends between the second end and the intermediate portion, and the third mating surface includes a plurality of protruding portions, each protruding portion extending in a direction perpendicular to the longitudinal direction, and each protruding portion having a saw-tooth cross section that is sloped towards the second end of the joining member and is flat towards the first end of the joining member.

The first end of the joining member can have an aperture formed therein, and the joining member can have an internal passage that extends longitudinally therein from the aperture in the first end. Also, the joining member can have a first slot formed therein between the external surface and the internal passage, the first slot extending in the longitudinal direction from the first end to a point beyond the intermediate portion. The joining member can also have a second slot formed therein between the external surface and the internal passage, the second slot extending in the longitudinal direction from the first end to a point beyond the intermediate portion. Preferably, the second slot is diametrically opposed to the first slot.

The second end of the joining member can also have an aperture formed therein, and the internal passage can extend longitudinally between the aperture in the first end and the aperture in the second end, The joining member can have a third and a fourth slot formed therein between the external surface and the internal passage, the third and fourth slots extending in the longitudinal direction from the second end to a point beyond the intermediate portion. Preferably, the fourth slot is diametrically opposed to the third slot. It is also preferable for the joining member to have a circular cross section, and for the first slot to be offset from the third slot by an angle in a range of 80 degrees to 100 degrees, most preferably 90 degrees, as measured from the center of said circular cross section.

The first mating surface of the housing can include a plurality of protruding portion areas, each protruding portion area extending in the axial direction between the first aperture of the housing and the intermediate portion of the housing, and each protruding portion area also extending in a direction perpendicular to the axial direction, wherein the first mating surface further includes a plurality of non-protruding areas, and wherein the protruding portion areas and non-protruding areas are alternately disposed in the direction perpendicular to the axial direction. Preferably, the first mating surface has four protruding portion areas and four non-protruding areas, wherein the first mating surface has a circular cross section, and wherein each protruding portion area extends over an arc in a range of 40 degrees to 50 degrees as measured from the center of the circular cross section, most preferably over an arc of 45 degrees as measured from the center of the circular cross section.

The housing and the joining member can be formed from a mixture which includes a thermoplastic polymer. It is preferable for the thermoplastic polymer to be selected from a group consisting of polyphthalamide, polybutylene terephthalate, and polyamide 6.6. The mixture can also include glass fibers. It is preferable for the glass fibers to be a percentage of the mixture in a range of 45% to 55% by weight.

The housing can be formed from two corresponding halves, each provided with mechanical snap fittings to hold the two halves together when assembled.

According to another embodiment of the present invention, a reinforced concrete sectional pile is provided comprising a reinforcing bar molded into a concrete pile section, the reinforcing bar extending in a longitudinal direction. The reinforced concrete pile also comprises a housing provided on an end of the reinforcing bar, the housing having a first interior surface defining a first passage that extends in the longitudinal direction between a first aperture and an intermediate portion of the housing, and a second interior surface defining a second passage that extends in the longitudinal direction between a second aperture and the intermediate portion of the housing, wherein the end of the reinforcing bar is disposed within the second passage of the housing. The reinforced concrete pile further comprises a joining member for joining the housing to a second housing, the joining member having an exterior surface, wherein the first interior surface includes a first mating surface, and the exterior surface includes a second mating surface, and wherein the first and second mating surfaces are configured such that the second member can be inserted and thereby locked into the first passage.

BRIEF DESCRIPTION OF THE DRAWINGS

An embodiment of the present invention will now be described by way of example only, with reference to the accompanying drawings in which.

DETAILED DESCRIPTION OF THE DRAWINGS

Figures 1, 2:
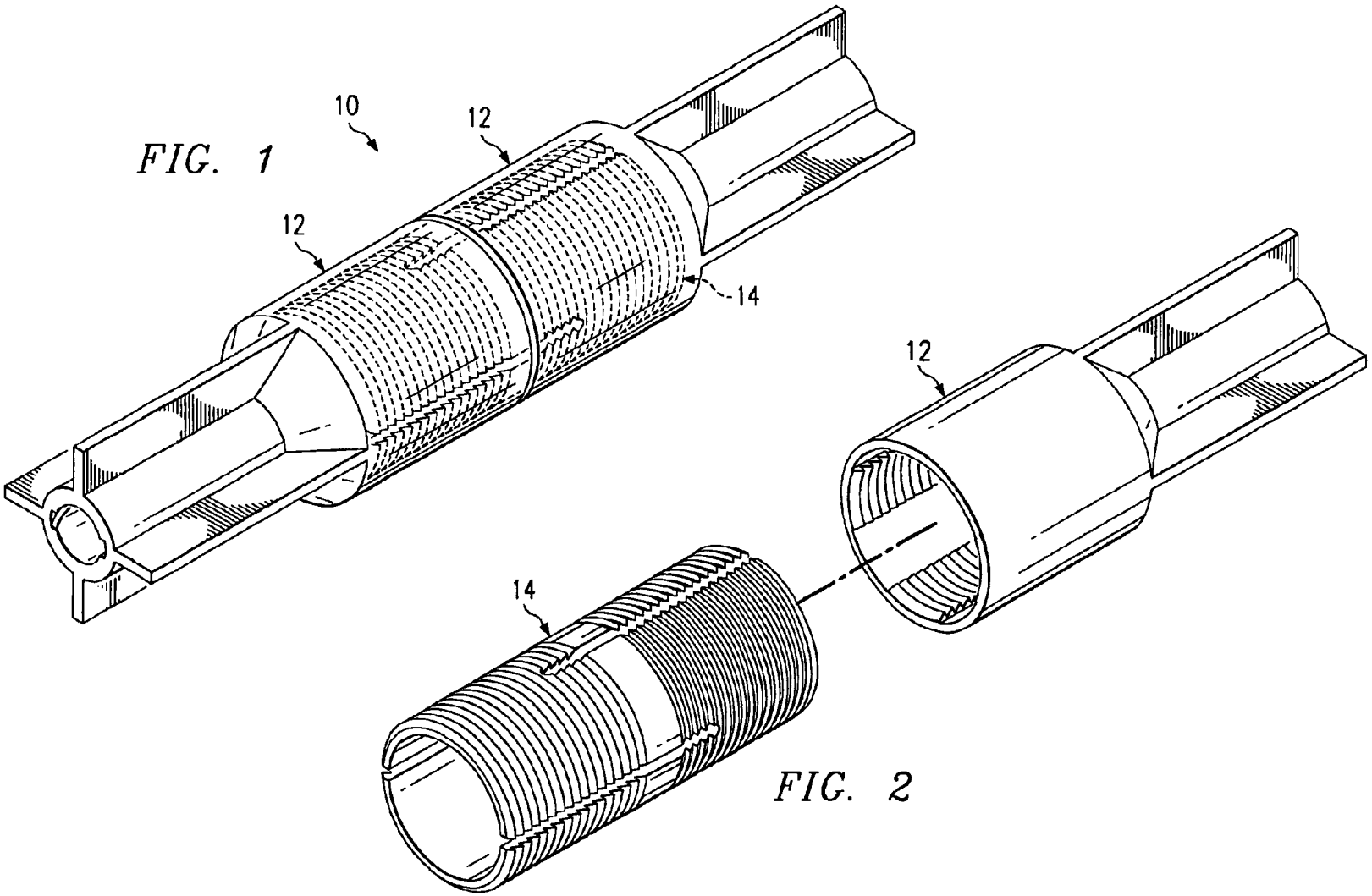
FIG. 1 is a perspective view of an assembled connector in accordance with the present invention.
FIG. 2 is an exploded view for illustrating how a portion of the connector shown in FIG. 1 can be assembled.

FIG. 1 shows a connector 10 in accordance with an embodiment of the present invention. The connector 10 includes a pair of housings 12 and a joining member 14, which is shown in phantom in FIG. 1.

FIG. 2 is an exploded view of a portion of the connector 10 illustrating how the joining member 14 can be assembled with one of the housings 12. The details relating to how the housing 12 and the joining member 14 can be assembled with one another will be easier to understand after the following discussions, which provide more details of each of the housing 12 and the joining member 14.

Figure 3:
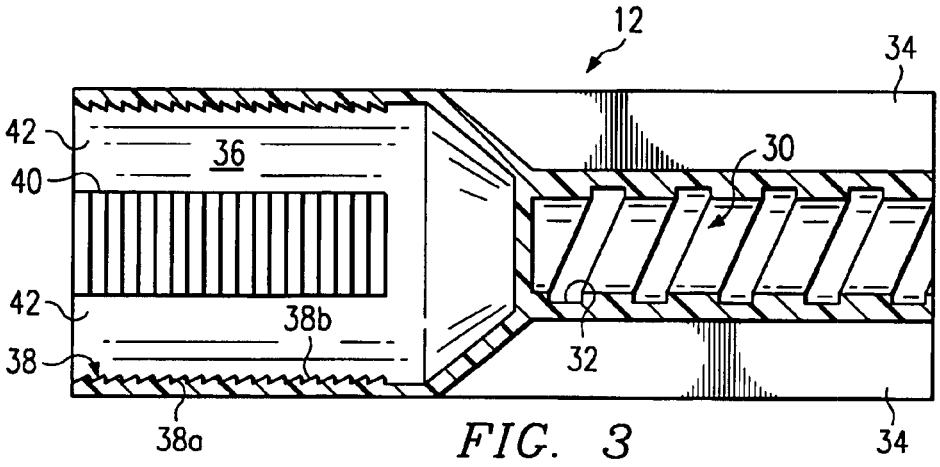
FIG. 3 is a cross sectional view of a housing of a connector in accordance with the present invention.
Figure 4:
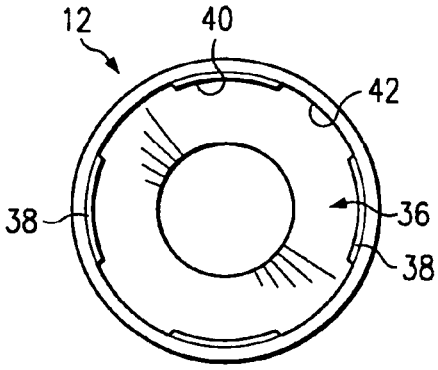
FIG. 4 is a view of an end of the housing shown in FIG. 3.
Figure 5:
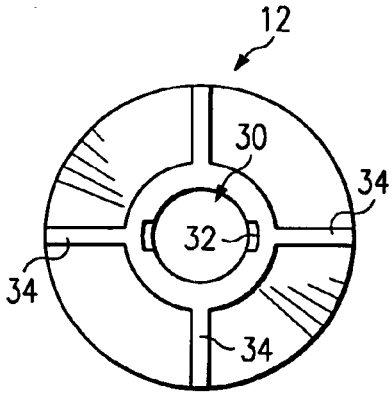
FIG. 5 is a view of another end of the housing shown in FIG. 3.
Figure 9:
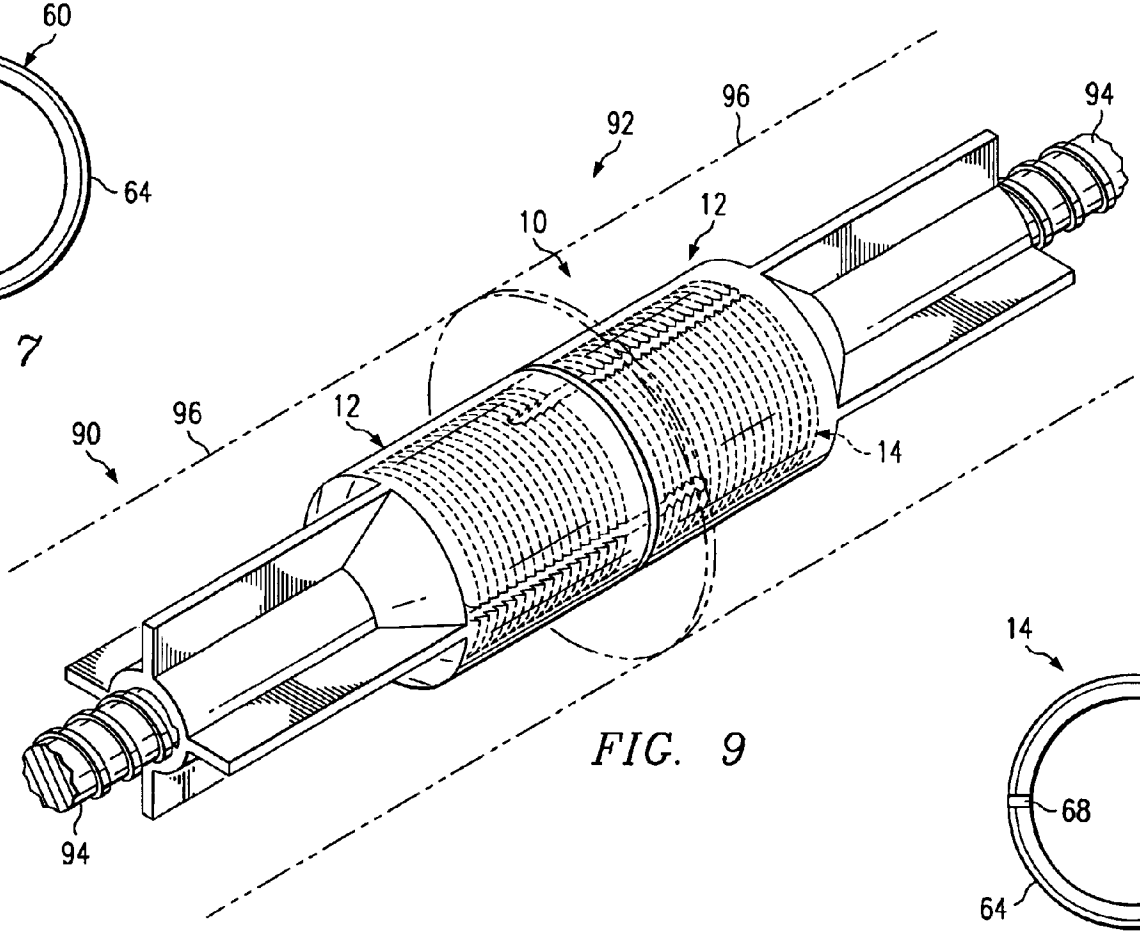
FIG. 9 is a view of a pair of reinforced concrete pile section connected in an end-to-end relationship in accordance with the present invention.

First, the housing 12 will be described with reference to FIGS. 3–5. The housing 12 has a first attachment socket 30 at a first end thereof. The first attachment socket 30 has an internal thread 32 to accommodate helical protrusions, or threads, formed on an outer surface of a standard reinforcing bar (as shown in FIG. 9). In the present embodiment, four radially extending strengthening ribs 34 extend from the outer surface of the attachment socket 10. However, the present invention is not limited to four ribs 34; rather, any number of ribs 34 may be used without departing from the spirit and scope of the present invention.

The housing 12 also has a second attachment socket 36 which, in this embodiment, has a circular cross section. The second attachment socket 36 is provided at a second end of the housing 12. Protrusions 38 having a saw tooth configuration project inwardly from the inner walls of the second attachment socket 36. Each protrusion 38 has an inner face 38*a*, which is generally perpendicular to the socket wall, and an outer face 38*b*, which is inclined inwardly with respect to an entrance at the second end of the second attachment socket 36. According to the present invention, the protrusions 38 can comprise annular protrusions that extend continuously around the internal wall of the socket, but in the present preferred embodiment the protrusions 38 comprise four serrated wall sections 40 spaced from each other by wall sections 42 having no substantial protrusion therefrom. It should be noted that the number and style of serrated wall sections 40 can be varied without departing from the spirit and scope of the present invention.

The housing 12 is preferably molded as a single member from a thermoplastics polymer, most preferably polyphthalamide. The polymer also preferably includes between 45% and 55% glass fiber reinforcement material to enhance its mechanical properties. However, the housing 12 is not limited to such a composition and method of construction. For example, the housing 12 can be molded as a single member from a metal or a ceramic material, or constructed in some way using pieces from a single one of or a combination of types of materials.

Figure 6:
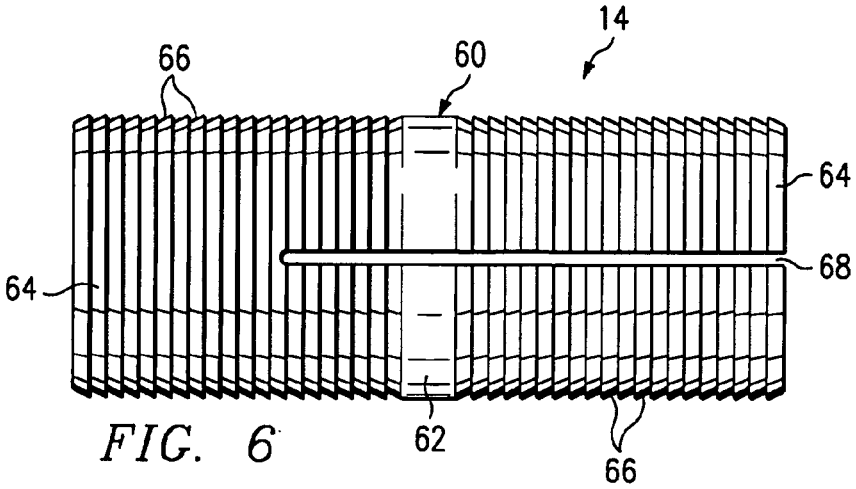
FIG. 6 is a view of a joining member of a connector in accordance with the present invention.
Figure 8:
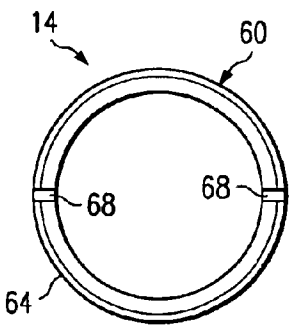
FIG. 8 is a view of another end of the joining member shown in FIG. 6.
Figure 7:
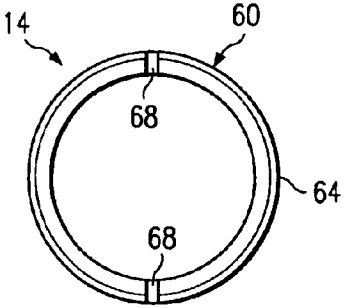
FIG. 7 is a view of an end of the joining member shown in FIG. 6.

Next, the joining member 14 will be described with reference to FIGS. 6–8. The joining member 14 comprises a hollow cylinder 60, having a length between one and two times a depth of the second attachment socket 36, and having a first end, a second end, and a short central portion 62 with no substantial protrusions therefrom. Serrated sections 64 extend from each of the first end and the second end to the central portion 62 and have protrusions 66 configured to correspond with the configuration of the protrusions 38 from the serrated wall sections 40 of the second attachment socket 36. The protrusions 66 preferably extend around the entire circumference of the joining member 14; however, the present invention is not limited to this configuration. The joining member 14 is also provided with two diametral slots 68 extending longitudinally therealong from each of the first end and the second end and, preferably, to a point beyond the central portion 62. The slots 68 extending from the first end of the joining member 14 are displaced relative to the slots 68 extending from the second end, preferably by an angle in a range of 80° to 100°, most preferably by 90°, as measured from the center of the cross section of the joining member 14. The joining member 14 is preferably molded as a single component from glass fiber reinforced polyphthalamide; however, the joining member 14 is not limited to such a composition and method of construction. For example, the joining member 14 can be molded as a single member from a metal or a ceramic material, or constructed in some way using pieces from a single one of or a combination of types of materials.

FIG. 9 shows an example of how a connector 10 can be used to connect two reinforced concrete pile sections 90 and 92. While the connector 10 of the present embodiment is particularly well suited for connecting one reinforced concrete pile section 90 in an end-to-end relationship with a neighboring reinforced concrete pile section 92, the present invention is not limited to such a use.

Reinforced concrete pile sections 90 and 92 each comprise a central steel reinforcing bar 94 cast into concrete 96. The pile sections 90 and 92 may have square, circular or any other suitable cross sections. The first attachment socket 30 of the housing 12 can be fitted to an end of a respective reinforcing bar 94 prior to molding the concrete piles 90 and 92. Then, the concrete 96 of the respective concrete piles 90, 92 can be molded around the outer surface of the housing 12 and the reinforcing bar 94, leaving the opening to the second attachment socket 36 of the housing 12 exposed from an end face of the thus formed pile sections 90, 92. Two pile sections 90 and 92 formed in this manner, i.e., each having an opening to a second attachment socket 36 of a housing 12 cast therein exposed on an end face thereof, can be joined by bringing them together in an end-to-end relationship, each of the end faces having the second attachment sockets 36 exposed therefrom being placed face to face. A joining member 14 can be forced into the second attachment socket 36 of a first one of the two pile sections 90. The second pile section 92 can then be placed in an end-to-end relationship with the first pile section 90 such that part of the joining member 14 protruding from the end of the first pile section 90 can be inserted into the second attachment socket 36 of the second pile section 92. A pile driving operation can then cause full penetration of the joining member 14 into the second attachment socket 36 of each of the housings 12 cast in the pile sections 90 and 92, and an end-to-end abutment of the pile sections 90 and 92 can be achieved, as shown in FIG. 9.

Insertion of a joining member 14 into a second attachment socket 36 of a housing 12 is facilitated by a saw tooth configuration of the protrusions 38, which thereafter prevent withdrawal of the joining member 14 from the second attachment socket 36 and provide an interconnection between the reinforcing member 94 of the first pile section 90 and the reinforcing member 94 of the second pile section 92, the tensile strength of which can be at least as great that of the reinforcing member 94 itself.

Various modifications can be made without departing from the scope of the invention. For example, the housing, for ease of manufacture, can be manufactured from two halves created along a central longitudinal plane. Interconnection means in the form of mechanical snap fits can be provided on each section. Also, while the present invention has been described in relation to sectional piles, which comprise a single central reinforcing bar, other arrangements could be envisaged. For example, a plurality of reinforcing bars could be used, each connected in the manner of the invention to the corresponding reinforcing bar of the next pile section. In one possible arrangement, square pile sections would be provided with four reinforcing bars.

Alternative plastics materials can be used to form the joining member and housing. Suitable materials include polybutylene terephthalate and polyamide 6.6. Both may be reinforced with glass fiber.

While endeavoring in the foregoing specification to draw attention to those features of the invention believed to be of particular importance, it should be understood that the Applicant claims protection in respect of any patentable feature, or combination of features, hereinbefore referred to and/or shown in the drawings, whether or not particular emphasis has been placed thereon.

What is claimed is:

1. A connector comprising:

a housing having a first interior surface defining a first passage that extends in an axial direction between a first aperture and an intermediate portion of the housing, and a second interior surface defining a second passage that extends in the axial direction between a second aperture and the intermediate portion of the housing; and a joining member for joining the housing to a second housing, said joining member having an exterior surface, wherein said first interior surface includes a first mating surface, and said exterior surface includes a second mating surface, wherein said first and second mating surfaces are configured such that the joining member can be inserted and thereby locked into the first axially extending passage, wherein said first mating surface of the housing includes a plurality of protruding portions, each protruding portion extending in a direction perpendicular to said axial direction, each protruding portion having a saw-tooth cross section that is sloped towards the first aperture of the housing and flat towards the intermediate portion of the housing, wherein said joining member has a first end and a second end thereof and extends in a longitudinal direction between said first and second ends thereof, and wherein said second mating surface includes a plurality of protruding portions, each protruding portion extending in a direction perpendicular to said longitudinal direction, and each protruding portion having a saw-tooth cross section that is sloped towards said first end of the joining member and is flat towards said second end of the joining member, wherein the exterior surface of the joining member extends between the first end of the joining member and the second end of the joining member and includes an intermediate portion thereof, wherein said second mating surface extends between the first end of the joining member and the intermediate portion of the joining member, wherein the exterior surface of the joining member includes a third mating surface that extends between the second end of the joining member and the intermediate portion of the joining member, and wherein said third mating surface includes a plurality of protruding portions, each protruding portion extending in a direction perpendicular to said longitudinal direction, and each protruding portion having a saw-tooth cross section that is sloped towards the second end of the joining member and is flat towards the first end of the joining member, wherein the first end of the joining member has an aperture formed therein, wherein the joining member has an internal passage that extends longitudinally therein from said aperture in the first end of the joining member, and wherein the joining member has a first slot formed therein between the exterior surface of the joining member and the internal passage of the joining member, the first slot extending in said longitudinal direction from the first end of the joining member to a point beyond the intermediate portion of the joining member.

2. A connector in accordance with claim 1, wherein the joining member has a second slot formed therein between the exterior surface of the joining member and the internal passage of the joining member, the second slot extending in said longitudinal direction from the first end of the joining member to a point beyond the intermediate portion of the joining member, and wherein the second slot is diametrically opposed to the first slot.

3. A connector in accordance with claim 2, wherein the second end of the joining member has an aperture formed therein, wherein the internal passage of the joining member extends longitudinally between the aperture in the first end of the joining member and the aperture in the second end of the joining member, wherein the joining member has a third slot formed therein between the exterior surface of the joining member and the internal passage of the joining member, the third slot extending in said longitudinal direction from the second end of the joining member to a point beyond the intermediate portion of the joining member, wherein the joining member has a fourth slot formed therein between the exterior surface of the joining member and the internal passage of the joining member, the fourth slot extending in said longitudinal direction from the second end of the joining member to a point beyond the intermediate portion of the joining member, and wherein the fourth slot is diametrically opposed to the third slot.

4. A connector in accordance with claim 3, wherein the joining member has a circular cross section, and wherein the first slot is offset from the third slot by an angle in a range of 80 degrees to 100 degrees measured from the center of the circular cross section of the joining member.

5. A connector in accordance with claim 4, wherein the first slot is offset from the third slot by an angle of 90 degrees measured from the center of the circular cross section of the joining member.

6. A connector comprising:

a housing having a first interior surface defining a first passage that extends in an axial direction between a first aperture and an intermediate portion of the housing, and a second interior surface defining a second passage that extends in the axial direction between a second aperture and the intermediate portion of the housing; and a joining member for joining the housing to a second housing, said joining member having an exterior surface, wherein said first interior surface includes a first mating surface, and said exterior surface includes a second mating surface, wherein said first and second mating surfaces are configured such that the joining member can be inserted and thereby locked into the first axially extending passage, wherein said first mating surface of the housing includes a plurality of protruding portions, each protruding portion extending in a direction perpendicular to said axial direction, each protruding portion having a saw-tooth cross section that is sloped towards the first aperture of the housing and flat towards the intermediate portion of the housing, wherein the first mating surface includes a plurality of protruding portion areas, each protruding portion area extending in said axial direction between the first aperture of the housing and the intermediate portion of the housing, and each protruding portion area also extending in a direction perpendicular to said axial direction, wherein the first mating surface further includes a plurality of non-protruding areas, and wherein the protruding portion areas and non-protruding areas are alternately disposed in the direction perpendicular to said axial direction.

7. A connector in accordance with claim 6, wherein the first mating surface has four protruding portion areas and four non-protruding areas, wherein the first mating surface has a circular cross section, and wherein each protruding portion area extends over an arc in a range of 40 degrees to 50 degrees from the center of the circular cross section of the housing.

8. A connector in accordance with claim 7, wherein each protruding portion area and each non-protruding area extends over an arc of 45 degrees from the center of the circular cross section of the housing.

9. A connector in accordance with claim 1, wherein the housing is formed from a plastic material selected from a group consisting of polyphthalamide, polybutylene terephthalate, and polyamide 6.6.

10. A connector in accordance with claim 9, wherein said plastic material is polyphthalamide.

11. A connector in accordance with claim 1, wherein said joining member is formed from a plastic material selected from a group consisting of polyphthalamide, polybutylene terephthalate, and polyamide 6.6.

12. A connector in accordance with claim 11 wherein said plastic material is polyphthalamide.

13. A connector in accordance with claim 1, wherein said housing is formed from a mixture which includes a thermoplastic polymer and glass fibers.

14. A connector in accordance with claim 13, wherein the thermoplastic polymer is polyphthalamide.

15. A connector in accordance with claim 13, wherein the glass fibers are a percentage of the mixture in a range of 45% to 55% by weight.

16. A connector in accordance with claim 1, wherein the joining member is formed from a mixture which includes a thermoplastic polymer and glass fibers.

17. A connector in accordance with claim 16, wherein the thermoplastic polymer is polyphthalamide.

18. A connector in accordance with claim 16, wherein the glass fibers are a percentage of the mixture in a range of 45% to 55% by weight.

19. A connector comprising:

a housing having a first interior surface defining a first passage that extends in an axial direction between a first aperture and an intermediate portion of the housing, and a second interior surface defining a second passage that extends in the axial direction between a second aperture and the intermediate portion of the housing; and a joining member for joining the housing to a second housing, said joining member having an exterior surface, wherein said first interior surface includes a first mating surface, and said exterior surface includes a second mating surface, wherein said first and second mating surfaces are configured such that the joining member can be inserted and thereby locked into the first axially extending passage, wherein the housing is formed from two corresponding halves, each provided with mechanical snap fittings to hold the two halves together when assembled.

20. A reinforced concrete sectional pile comprising:

a reinforcing bar molded into a concrete pile section, said reinforcing bar extending in a longitudinal direction;

a housing provided on an end of the reinforcing bar, said housing having a first interior surface defining a first passage that extends in said longitudinal direction between a first aperture and an intermediate portion of the housing, and a second interior surface defining a second passage that extends in said longitudinal direction between a second aperture and the intermediate portion of the housing, wherein the end of the reinforcing bar is disposed within the second passage of the housing; and a joining member for joining the housing to a second housing, said joining member having an exterior surface, wherein said first interior surface includes a first mating surface, and said exterior surface includes a second mating surface, wherein said first and second mating surfaces are configured such that the second member can be inserted and thereby locked into the first passage, and wherein the first mating surface includes a plurality of protruding portions, each protruding portion extending in a direction perpendicular to said longitudinal direction, each protruding portion having a saw-tooth cross section that is sloped towards the first aperture of the housing and flat towards the intermediate portion of the housing.

21. A reinforced concrete sectional pile in accordance with claim 20, wherein the housing has an extending portion which extends radially from an external side of the housing.

22. A reinforced concrete sectional pile in accordance with claim 21, wherein the external side of the housing has a plurality of extending portions extending radially therefrom, each extending portion also extending in said longitudinal direction between the second aperture of the housing and the intermediate portion of the housing, wherein said extending portion is one of the plurality of extending portions.

23. A reinforced concrete pile comprising:

a reinforcing bar molded into a concrete pile section, said reinforcing bar extending in a longitudinal direction;

a housing provided on an end of the reinforcing bar, said housing having a first interior surface defining a first passage that extends in said longitudinal direction between a first aperture and an intermediate portion of the housing, and a second interior surface defining a second passage that extends in said longitudinal direction between a second aperture and the intermediate portion of the housing, wherein the end of the reinforcing bar is disposed within the second passage of the housing; and a joining member for joining the housing to a second housing, said joining member having an exterior surface, wherein said first interior surface includes a first mating surface, and said exterior surface includes a second mating surface, and wherein the joining member is formed from a mixture which includes a thermoplastic polymer and glass fibers.

24. A reinforced concrete sectional pile in accordance with claim 23, wherein said first and second mating surfaces are configured such that the second member can be inserted and thereby locked into the first passage, wherein the first mating surface includes a plurality of protruding portions, each protruding portion extending in a direction perpendicular to said longitudinal direction, each protruding portion having a saw-tooth cross section that is sloped towards the first aperture of the housing and flat towards the intermediate portion of the housing.

25. A reinforced concrete sectional pile in accordance with claim 24, wherein the joining member has a first end and a second end thereof and extends in an axial direction between said first end and said second end, and wherein the second mating surface includes a plurality of protruding portions, each protruding portion extending in a direction perpendicular to said axial direction, and each protruding portion having a saw-tooth cross section that is sloped towards the first end of the joining member and is flat towards the second end of the joining member.

26. A reinforced concrete pile comprising:

a reinforcing bar molded into a concrete pile section, said reinforcing bar extending in a longitudinal direction;

a housing provided on an end of the reinforcing bar, said housing having a first interior surface defining a first passage that extends in said longitudinal direction between a first aperture and an intermediate portion of the housing, and a second interior surface defining a second passage that extends in said longitudinal direction between a second aperture and the intermediate portion of the housing, wherein the end of the reinforcing bar is disposed within the second passage of the housing; and a joining member for joining the housing to a second housing, said joining member having an exterior surface, wherein said first interior surface includes a first mating surface, and said exterior surface includes a second mating surface, and wherein the housing is formed from a mixture which includes a thermoplastic polymer and glass fibers.

27. A reinforced concrete pile in accordance with claim 26, wherein the thermoplastic polymer is selected from a group consisting of polyphthalamide, polybutylene terephthalate, and polyamide 6.6.

28. A reinforced concrete pile in accordance with claim 23, wherein the thermoplastic polymer is selected from a group consisting of polyphthalamide, polybutylene terephthalate, and polyamide 6.6.

* * * * *